US006254755B1

(12) United States Patent
Miura et al.

(10) Patent No.: US 6,254,755 B1
(45) Date of Patent: Jul. 3, 2001

(54) ELECTROPLATING PROCESS FOR OLDHAM RING AND SCROLL MEMBER TYPE COMPRESSOR COMPRISING THE SAME

(75) Inventors: Shigeki Miura; Kimiharu Takeda; Nobuo Hagi, all of Nishi-kasugai-gun; Kazuhiko Inoguchi, Nagoya, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/346,267

(22) Filed: Jul. 1, 1999

(30) Foreign Application Priority Data

Jul. 17, 1998 (JP) ..... 10-204075

(51) Int. Cl.[7] ..... C25D 5/00; C25D 7/04

(52) U.S. Cl. ..... 205/96; 205/149; 205/151

(58) Field of Search ..... 205/149, 151, 205/73, 96; 418/178, 55.3, 179

(56) References Cited

PUBLICATIONS

U.S. application No. 09/346,267, Miura et al., filed Jul. 1, 1999.*

* cited by examiner

*Primary Examiner*—Kathryn Gorgos
*Assistant Examiner*—Michael J Feely
(74) *Attorney, Agent, or Firm*—Oblon, Spivak, McClelland, Maier & Neustadt, P.C.

(57) ABSTRACT

The object of the present invention is to provide an Oldham ring having uniform electroplating thickness and a scroll member type compressor comprising the same; in order to accomplish the above object, the electroplating process for plating an Oldham ring comprising a ring body and a plurality of key portions extending outwardly from the ring body of the present invention comprises the steps of: soaking the Oldham ring in a plating liquid; arranging at least two cathodes respectively on the inside wall of the ring body at positions corresponding to the areas between each adjacent pair of the key portions; and electroplating the Oldham ring by passing electric current between the cathodes and at least one anode contacting to the plating liquid.

5 Claims, 4 Drawing Sheets

ELECTROPLATING PROCESS FOR OLDHAM RING AND SCROLL MEMBER TYPE COMPRESSOR COMPRISING THE SAME

BACKGROUND OF THE INVENTION

1. Field of the Invention

The present invention relates to an electroplating process for an Oldham ring preventing the autorotation of an orbiting scroll member and having a uniform plating thickness, and a scroll member type compressor comprising the same.

This application is based on Japanese Patent Application No. Hei 10-204075, the contents of which are incorporated herein by reference.

2. Description of the Related Art

A compressor is provided as a refrigerator in air conditioning systems such as an air conditioner provided in a car. The compressor compresses a gas refrigerant supplied from an evaporator, and expels the gas refrigerant under high temperature and high pressure.

Various types of compressors containing a scroll member type compressor have been suggested. The scroll member type compressor comprises a fixed scroll member and an orbiting scroll member which respectively have a spiral wrap. The orbiting scroll member eccentrically orbits relative to the fixed scroll member while the spiral wrap comprising the orbiting scroll member engages the spiral wrap comprising the fixed scroll member. Specifically, the position of the fixed scroll member is displaced 180° behind in an orbiting direction of the orbiting scroll member. An Oldham ring is provided on the rear surface of the orbiting scroll member. The Oldham ring allows the orbit of the orbiting scroll member relative to the fixed scroll member, but prevents the autorotation of the orbiting scroll member. A space is made between the spiral wraps, because the position of the fixed scroll member is displaced 180° behind in an orbiting direction of the orbiting scroll member. That is, a compressed space is made between the spiral wrap of the fixed scroll member and the spiral wrap of the orbiting scroll member. Refrigerant is introduced in the compressed space, then the orbiting scroll member eccentrically orbits relative to the fixed scroll member. Therefore, the compressed space is compressed so that the central part of the compressed space is more compressed than the circumferential part thereof Thereby, the refrigerant is compressed depending on the orbit of the orbiting scroll member relative to the fixed scroll member.

When a mixture containing a refrigerant and an oil is introduced in the compressor, the oil contained in the mixture is stirred by the orbiting scroll member, Oldham ring, and the like; whereby the scroll member type compressor is lubricated. However, when the compressor is not used for a long time, the oil coating the Oldham ring accumulates at the bottom of the compressor. Therefore, oil cannot instantly coat the Oldham ring when the compressor starts up after long disuse time. At this time, it is possible that the compressor is scorched because the absence of a lubricant.

In order to prevent such scorching, electroplating an Oldham ring made of iron sintered metals with tin has been suggested. The anti-scorching property of the Oldham ring is remarkably improved by the electroplating. FIG. 5 shows this electroplating process. In FIG. 5, the Oldham ring 1 is immersed in the plating liquid L containing sulfuric acid and tin sulfate. Ends 2 and 2 of a cathode, that is, electrodes are placed at the upside and the downside of the inside wall of the Oldham ring 1. That is, the electrodes 2 and 2 are placed near the key portions 3*a* and 3*c* of the Oldham ring 1. In addition, the electrodes 2 and 2 can be placed at the right side and the left side of the Oldham ring 1. That is, the electrodes 2 and 2 can be placed near the key portions 3*b* and 3*d* of the Oldham ring 1. For example, when the electrodes 2 and 2 are located near the key portions 3*a* and 3*c*, almost all of current flows to the key portions 3*a* and 3*c*. Therefore, the key portions 3*a* and 3*c* are electroplated more thickly than the key portions 3*b* and 3*d*. In contrast, when the electrodes 2 and 2 are located near the key portions 3*b* and 3*d*, almost all of the current flows to the key portions 3*b* and 3*d*. Therefore, the key portions 3*b* and 3*d* are electroplated more thickly than the key portions 3*a* and 3*c*. When the electroplated layer of the key portions is thicker than the electroplated layer of other key portions, it is difficult to fit the key portions in grooves formed in the element other than the Oldham ring. That is, it is difficult to smoothly fit the Oldham ring to other elements.

SUMMARY OF THE INVENTION

It is therefore an object of the present invention to provide an Oldham ring having uniform electroplating thickness and a scroll member type compressor comprising the same.

In order to accomplish the above object, the electroplating process for plating an Oldham ring comprising a ring body and a plurality of key portions extending outwardly from the ring body, comprising the steps of:

soaking the Oldham ring in a plating liquid;

arranging at least two cathodes respectively at the inside wall of the ring body at positions corresponding to the areas between each adjacent pair of the key portions; and electroplating the Oldham ring by passing electric current between the cathodes and at least one anode contacting to the plating liquid.

According to the electroplating process for an Oldham ring of the present invention, it is possible to provide an Oldham ring having a uniform plating thickness. Because the electrodes are located between the key portions, current is not collected by specified key portions. Current uniformly passes through the Oldham ring. Therefore, the Oldham ring is electroplated so that the electroplating thickness of the entire Oldham ring is uniform. Therefore, it is possible to smoothly fit the key portions of the Oldham ring in grooves formed in other elements.

Moreover, a scroll member type compressor comprising:

a housing;

a fixed scroll member and an orbiting scroll member respectively comprising a spiral wrap, being mounted in the housing, and the orbiting scroll member orbiting relative to the fixed scroll member while the spiral wrap of the fixed scroll member engages the spiral wrap of the orbiting scroll member; and an Oldham ring comprising a ring body and a plurality of key portions extending outwardly from the ring body, and maintaining the orbit of the orbiting scroll member relative to the fixed scroll member, but preventing the autorotation of the orbiting scroll member;

wherein the Oldham ring is produced by soaking the Oldham ring in a plating liquid; arranging at least two cathodes respectively at the inside wall of the ring body at positions corresponding to the areas between each adjacent pair of the key portions; and electroplating the Oldham ring by passing electric current between the cathodes and at least one anode contacting to the plating liquid.

According to the scroll member type compressor of the present invention, the scroll member type compressor comprises the Oldham ring comprising a plurality of key portions having a uniform plating layer for preventing a scorching thereof. The Oldham ring comprising key portions having a uniform plating layer; therefore, the Oldham ring can be smoothly fitted in grooves formed in the other elements, that is, the orbiting scroll member and the casing. Therefore, it is possible to provide a scroll member type compressor comprising the Oldham ring smoothly fitting to other elements.

DETAILED DESCRIPTION OF THE PREFERRED EMBODIMENTS

Referring to FIGS. 1 to 4, the preferred embodiment of the Oldham ring and the scroll member type compressor comprising the same according to the present invention will be explained.

Figure 2:
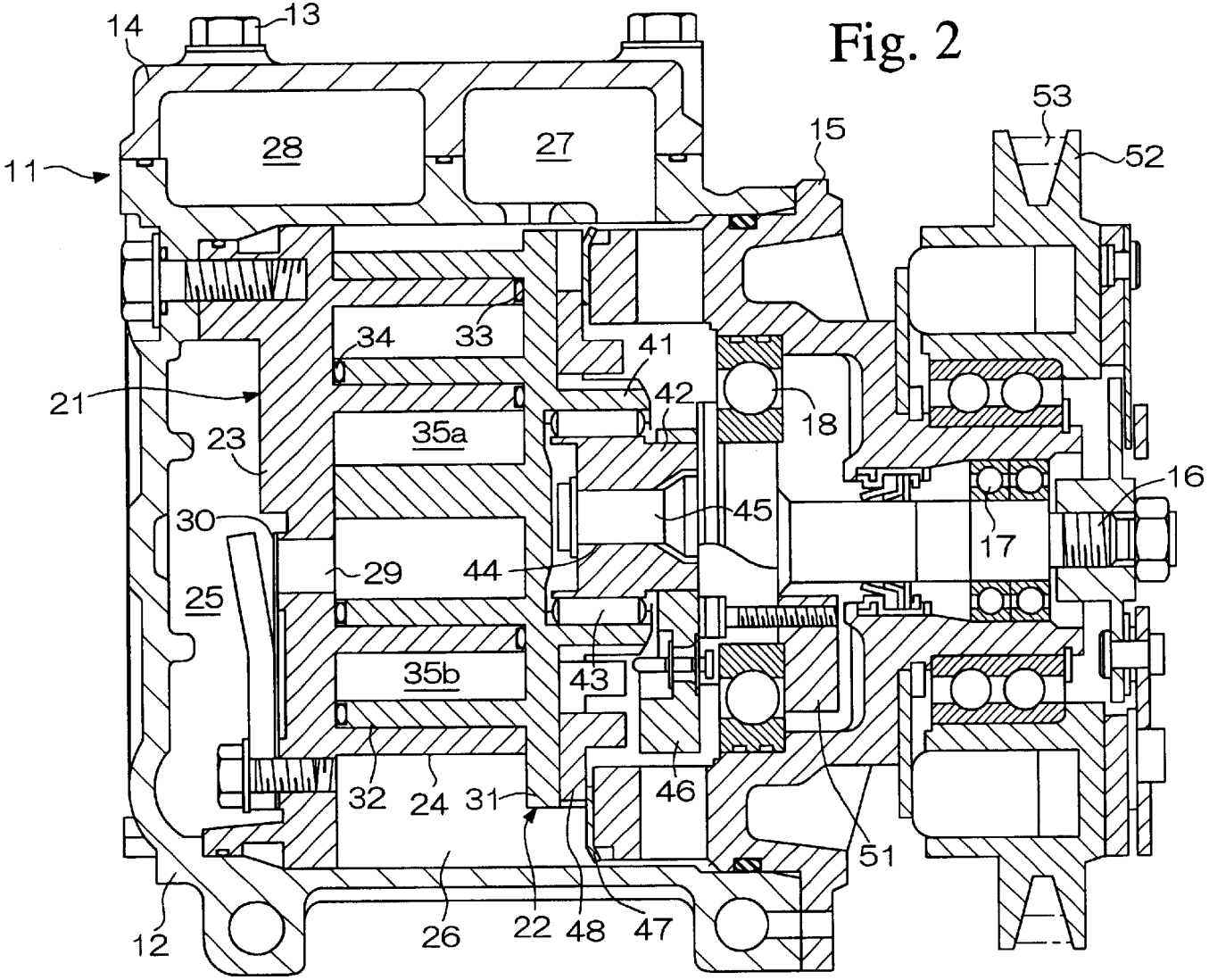
FIG. 2 shows a preferred embodiment of the scroll member type compressor.

FIG. 2 shows a sectional view of a scroll member type compressor used for an air conditioner provided in a car. The scroll member type compressor comprises a sealed housing 11. The sealed housing 11 further comprises a housing main body 12 having a cup shape, a cover 14, and a casing 15. The cover 14 is fixed to the housing main body 12 with bolts 13. The casing 15 is also fixed to the housing main body 12 with bolts not shown in FIG. 2. Moreover, the rotating shaft 16 passes through the casing 15, and is rotatably supported by the sealed housing 11, via bearings 17 and 18.

The fixed scroll member 21 and the orbiting scroll member 22 are provided in the sealed housing 11. The fixed scroll member 21 comprises an end plate 23 and a spiral wrap 24 which is vertically mounted inside of the end plate 23. The end plate 23 is fixed to the housing main body 12 with bolts not shown in FIG. 2.

The inside of the sealed housing 11 is partitioned by closely providing the end plate 23 inside the housing main body 12, that is, by tightly contacting the circumferential surface of the end plate 23 and the inside wall of the housing main body 12. Thereby, a high pressure space 25 can be formed in the outside of the end plate 23. Namely, the high pressure space 25 is formed by the end plate 23 and the housing main body 12. In addition, a low pressure space 26 is also formed in the inside of the end plate 23. That is, the low pressure space 26 is partitioned by the inside wall of end plate 23, the circumferential surface of the spiral wrap 24 comprising the fixed scroll member 21, and the inside wall of the housing main body 12, in FIG. 2.

An intake chamber 27 and an exhaust chamber 28 are provided by combining the cover 14 and the housing main body 12. The intake chamber 27 is directly connected to the low pressure space 26. In contrast, the exhaust chamber 28 is connected to the high pressure space 25, via a channel not shown in FIG. 2.

An exhaust port 29 is provided at the centers of the end plate 23. A discharge valve 30 for opening or closing the exhaust port 29 is also provided at the exhaust port 29.

The orbiting scroll member 22 comprises the end plate 31 and an spiral wrap 32 which is vertically mounted the inside wall of the end plate 31. The shape of the spiral wrap 32 comprising the orbiting scroll member 22 substantially equals that of the spiral wrap 24 comprising the fixed scroll member 21. As shown in FIG. 2, the center of the fixed scroll member 21 is spaced from the center of the orbiting scroll member 22 at an interval of the radius of orbiting. In addition, the fixed scroll member 21 and the orbiting scroll member 22 are positioned into an eccentric engagement. The fixed scroll member 21 is disposed 180° behind in an orbiting direction of the orbiting scroll member 22. A chip seal 33 embedded in the end of the spiral wrap 24 closely contacts the inside of the end plate 31 of the orbiting scroll member 22. A chip seal 34 embedded in the end of the spiral wrap 32 also closely contacts the inside of the end plate 23 of the fixed scroll member 21. When the orbiting scroll member 22 eccentrically orbits relative to the fixed scroll member 21, these spiral wraps 24 and 32 contact each other at a plurality of locations at which the vertical line extending the whole height of the spiral wrap 24 of the fixed scroll member 21 is in contact with the vertical line extending the whole height of the spiral wrap 32 of the orbiting scroll member 22. Thereby, a plurality of compression compartments 35*a* and 35*b* are formed. The compression compartment 35*a* and the compression compartment 35*b* are substantial symmetrically positioned with respect to center of the spiral wraps 24 and 32.

A driving bush 42 is rotatably fitted in a cylindrical boss 41 which is vertically provided at the rear surface of the end plate 31, via a rotating bearing 43. An eccentric pin 45 is slidably fitted in a slide conduit 44 formed in the driving bush 42. In addition, the eccentric pin 45 is eccentrically fitted at the inner end of the rotation shaft 16.

A balance weight 46 is provided to the driving bush 42, in order to maintain a kinetic unbalance, that is, an eccentric orbit of the orbiting scroll member 22. That is, the balance weight 46 is provided so that the bary center of the balance weight 46 is positioned in the area corresponding to the opposite side of the eccentric pin 45 with respect to the rotation shaft 16.

In FIG. 2, reference number 48 denotes an Oldham ring maintaining the orbit of the orbiting scroll member 22 relative to the fixed scroll member 21, but preventing the autorotation of the orbiting scroll member 22, reference number 47 denotes a slide bearing jammed between the outside peripheral of the Oldham ring 48 and the inside end face of the casing 15, and reference number 51 denotes a balance weight fixed to the rotation shaft 16.

An electromagnetic clutch 52 is provided for transmitting the motive power from the other shaft to the rotation shaft 16; therefore, the motive power from a driving engine is transmitted to the rotation shaft 16, via a belt 53 and the electromagnetic clutch 52. Then, the rotation shaft 16 rotates, whereby the orbiting scroll member 22 orbits, via an orbiting driving apparatus comprising the eccentric pin 45, the driving bush 42, and the cylindrical boss 41. Specifically, the orbiting scroll member 22 orbits while the autorotation of the orbiting scroll member 22 is prevented by the Oldham ring. The orbit of the orbiting scroll member 22 is substantially circular, with the radius being the distance between the center of the rotation shaft 16 and the center of the eccentric pin 45. When the orbiting scroll member 22 orbits, the contacting locations at which the vertical line extending the whole height of the spiral wrap 24 of the fixed scroll member 21 is in contact with the vertical line extending the whole height of the spiral wrap 32 of the orbiting scroll member 22, gradually move toward the centers of the spiral warps 24 and 32. That is, as the orbiting scroll member 22 orbits, the compressed compartments 35*a* and 35*b* made by contacting the spiral warps 24 and 32 move towards the center of the spiral wraps 24 and 32 while the volume of the compressed compartments 35*a* and 35*b* decreases.

While the orbiting scroll member 22 orbits, gas flows in the low pressure space 26, via an intake aperture not shown in FIG. 2 and the intake chamber 27. Then, gas is supplied from an aperture formed in the peripheral end portion of the spiral wraps 24 and 32 to the compression compartments 35*a* and 35*b*. Thereafter, gas is sent to the center space 54 while being compressed. Then gas further passes through the exhaust port 29, and presses and opens the discharge valve 30. After that, gas is sent into the high pressure space 25, and is discharged from an exhaust aperture not shown in FIG. 2, via the exhaust chamber 28.

In contrast, the refrigerant flows with oil into the air conditioner unit. When the mixture flows into the compressor, via the intake chamber 27, oil accumulates in the low pressure space 26. The accumulated oil is stirred by the orbiting scroll member 22, the Oldham ring 48, and the balance weight 46. Thereby, these elements are coated with oil, and the bearing 18, the rotating bearing 43, and the eccentric pin 45 are also lubricated.

Figure 3:
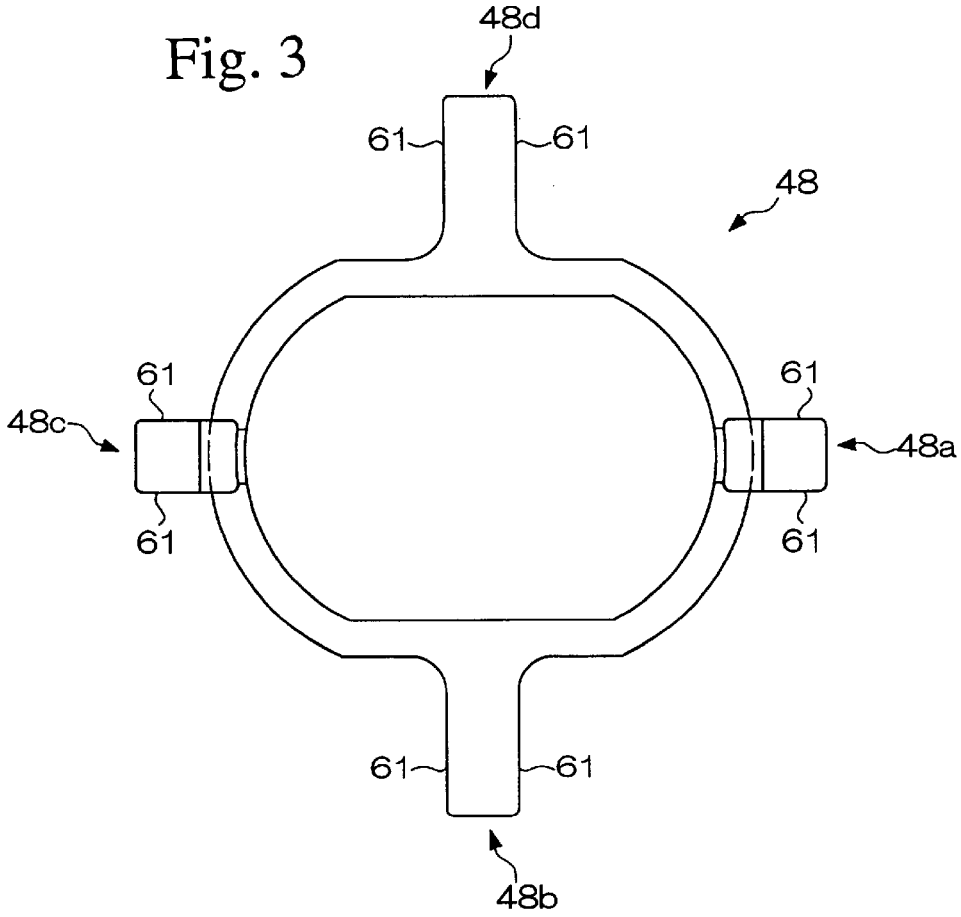
FIG. 3 is a plan view showing the Oldham ring of FIG. 2.
Figure 4:
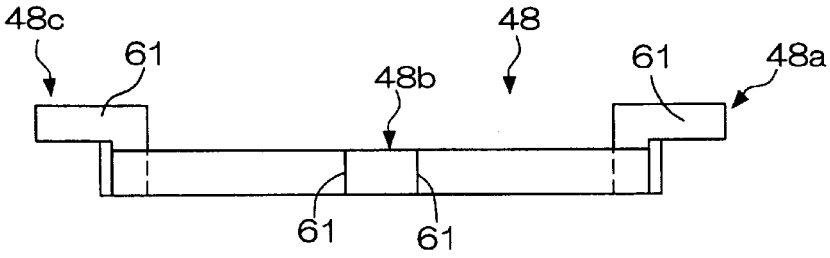
FIG. 4 is a cross-section view showing the Oldham ring of FIG. 2.

The Oldham ring used in the compressor comprises a ring body and a plurality of key portions 48*a*, 48*b*, 48*c*, and 48*d* extending outwardly from the ring body, as shown in FIGS. 3 and 4. These key portions 48*a*, 48*b*, 48*c*, and 48*d* are slidably fitted to grooves formed in the orbiting scroll member 22 and the casing 15. In order to prevent scorching due to contacting of the key portions 48*a*, 48*b*, 48*c*, and 48*d* with the grooves formed in the casing 15 and the orbiting scroll member 22, that is, to improve an anti-scorching property of the key portions 48*a*, 48*b*, 48*c*, and 48*d* of the Oldham ring 48, the surfaces 61 of these key portions 48*a*, 48*b*, 48*c*, and 48*d* are electroplated with tin.

Figure 1:
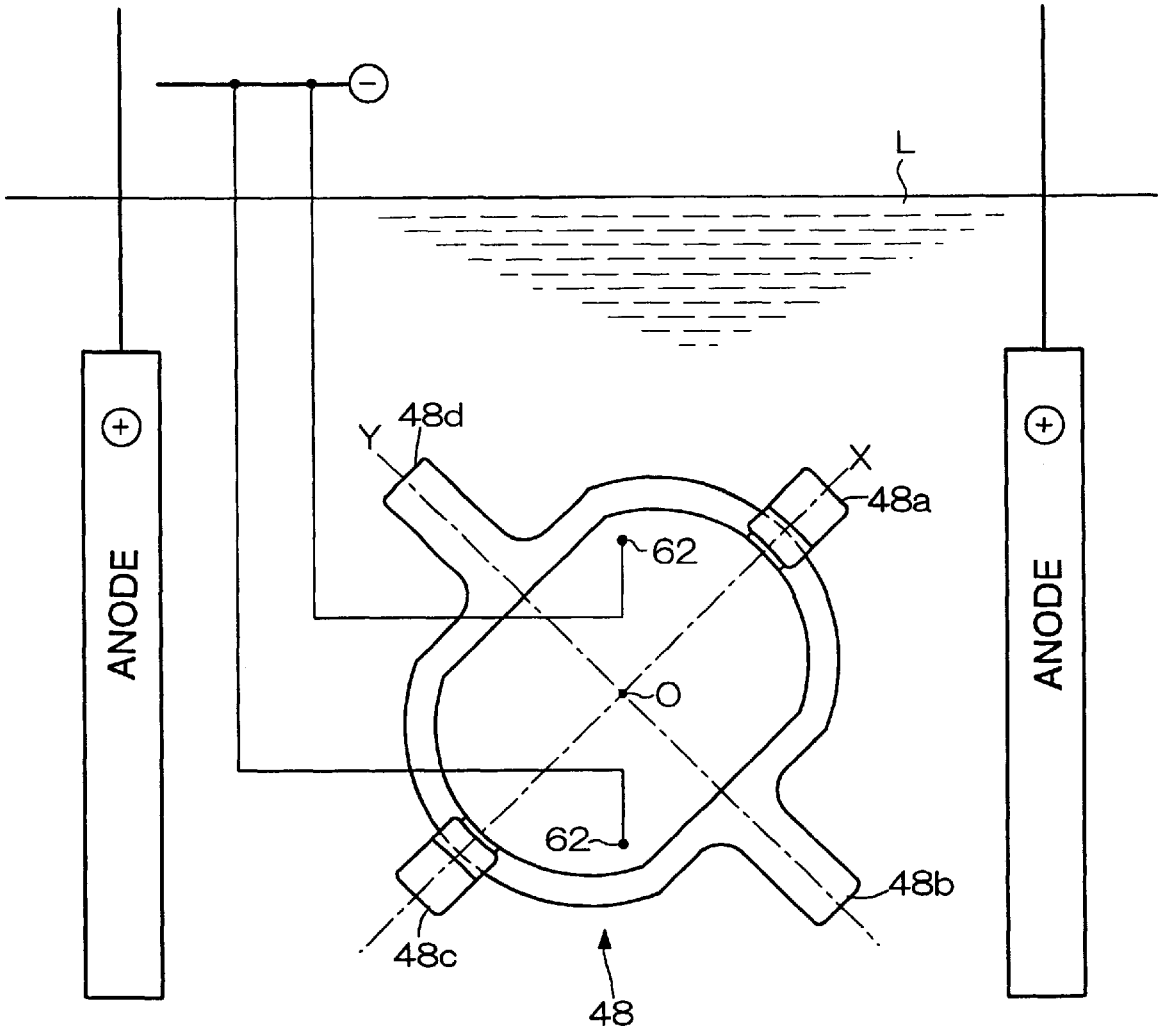
FIG. 1 shows a preferred embodiment of the cathode position adopted in the electroplating process for Oldham ring of the present invention.
Figure 5:
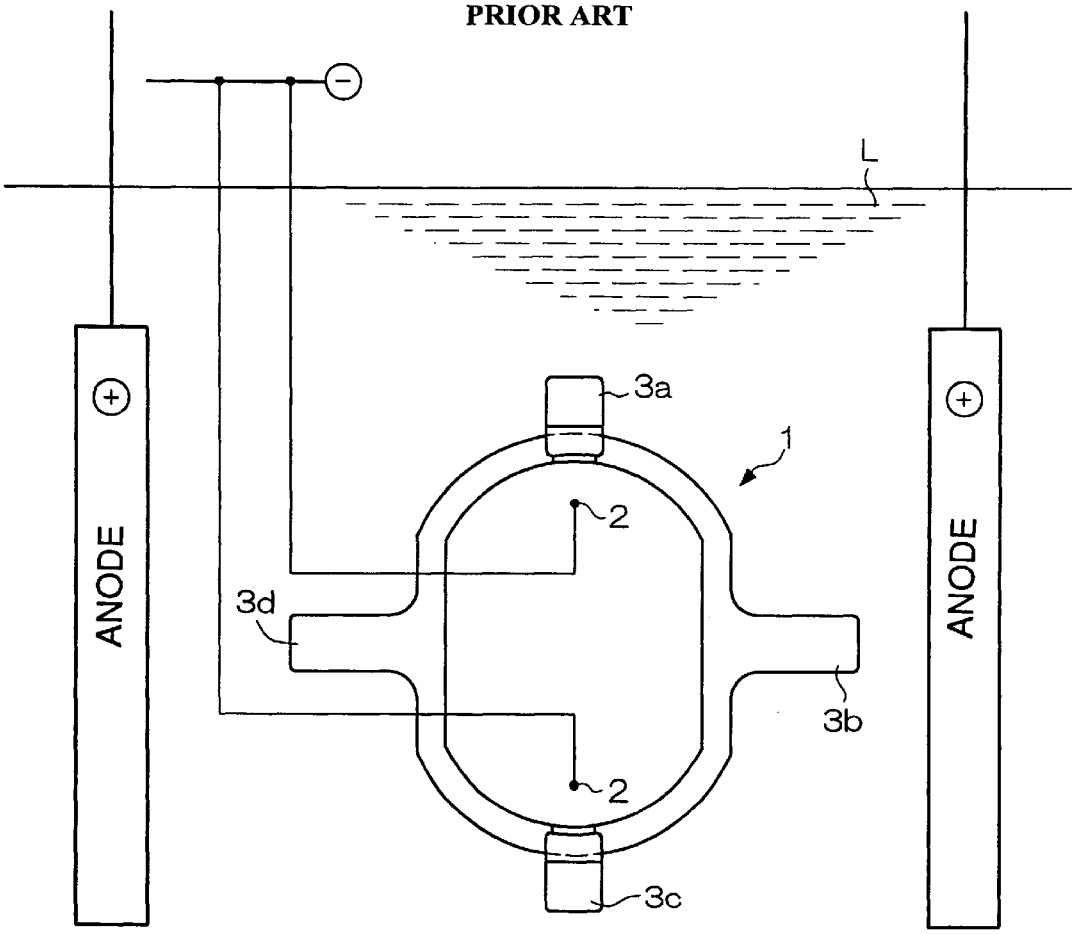
Fig. 5 PRIOR ART
FIG. 5 shows the cathode position adopted in the conventional electroplating process for Oldham ring.

The electroplating process for plating the Oldham ring 48 of the present invention will be explained reference to FIG. 1. Conventionally, the cathodes have been placed near the key portions 3*a* and 3*c*, or 3*b* and 3*d* as shown in FIG. 5. In contrast, in the present invention, the cathodes 62 and 62 are respectively arranged at the inside wall of the ring body at positions corresponding to the areas between each adjacent pair of the key portions 48*a* and 48*b*, 48*b* and 48*c*, 48*c* and 48*d*, and 48*d* and 48*a* in the electroplating process for plating the Oldham ring 48. It is preferable to arrange the cathodes 62 and 62 at the inside wall of the ring body at positions corresponding to the intermediate space between the key portions 48*a* and 48*b*, 48*b* and 48*c*, 48*c* and 48*d*, and 48*d* and 48*a*. It is more preferable to arrange the cathodes 62 and 62 on the bisector of angles formed with two lines respectively passing through the key portions 48*a* and 48*c*, and 48*b* and 48*d* which are positioned at opposite sides with respect to the center of the Oldham ring 48. That is, it is more preferable to arrange the cathodes 62 and 62 at the bisector of the angles formed with the X-line and the Y-line, as shown in FIG. 1. In particular, it is most preferable to arrange the cathodes 62 and 62 inside the ring body, at the bisector of the angles formed with the X-line and the Y-line shown in FIG. 1, with at least one anode arranged outside of the ring body.

Moreover, it is preferable that the cathodes are made of materials having low electric resistance such as copper. It is possible to hang the Oldham ring 48 in the plating liquid L with the cathodes. When the Oldham ring 48 is hung with the cathodes, it is preferable that the cathodes has a form and a size suitable for hanging the Oldham ring 48.

Moreover, two cathodes are arranged at the up side and the down side of the inside wall of the Oldham ring 48 in FIG. 1. However, it is possible to use four the cathodes and to arrange these cathodes at the up side, the down side, the right side, and the left side of the inside wall of the Oldham ring 48.

In addition, the cathodes are arranged on the inside wall of the ring body in the above preferred embodiment; however, it is possible to arrange the cathodes on the outside wall of the ring body.

After the cathodes 62 and 62 are arranged as described above, the Oldham ring 48 is soaked in the plating liquid L containing sulfuric acid and tin sulfate. Then, current passes between the anodes and the cathodes. These cathodes 62 and 62 are not arranged near the key portions 48*a*, 48*b*, 48*c*, and 48*d*; therefore, it is rarely required to correct electric current at the key portions 48*a*, 48*b*, 48*c*, and 48*d*. As a result, electric current uniformly flows in the Oldham ring 48. It is possible to uniformly electroplate the Oldham ring 48, in particular, the key portions 48*a*, 48*b*, 48*c*, and 48*d*. The Oldham ring 48 providing such key portions 48*a*, 48*b*, 48*c*, and 48*d* can smoothly slide in the grooves formed in the orbiting scroll member 22 and the casing 15.

What is claimed is:

1. An electroplating process for plating an Oldham ring having a ring body and a plurality of key portions extending outwardly from the ring body, comprising the steps of:

soaking the Oldham ring in a plating liquid;

arranging at least two cathodes respectively on the ring body at positions along the Oldham ring angularly displaced from lines passing through opposing pairs of the key portions; and electroplating the Oldham ring by passing electric current between the at least two cathodes and at least one anode contacting the plating liquid.

2. An electroplating process according to claim 1, wherein said arranging step comprises arranging at least two cathodes on at least one bisector of at least one angle formed by two of said lines each respectively passing through opposing key portions and a center of the Oldham ring.

3. An electroplating process according to claim 1, wherein said arranging step comprises arranging at least two cathodes on an inside wall of the ring body on at least one bisector bisecting at least one angle formed by two of said lines respectively passing through opposing key portions and a center of the Oldham ring.

4. An electroplating process according to claim 1, wherein the Oldham ring has four key portions and said arranging step comprises arranging two cathodes on an inside wall of the ring body at positions between two opposing adjacent pairs of the four key portions of the Oldham ring, at least one anode being arranged outside of the Oldham ring.

5. An electroplating process for plating an Oldham ring having a ring body and a plurality of key portions extending outwardly from the ring body, comprising the steps of:

soaking the Oldham ring in a plating liquid;

arranging at least two cathodes at respective positions on the ring body; and electroplating the Oldham ring by passing electric current between the at least two cathodes and at least one anode contacting the plating liquid, wherein said respective positions are sufficiently angularly displaced from lines defined by opposing pairs of key portions to an extent such that said plurality of key portions of said Oldham ring are substantially uniformly plated during said electroplating step.

* * * * *